US008047155B1

(12) United States Patent
Dean et al.

(10) Patent No.: US 8,047,155 B1
(45) Date of Patent: Nov. 1, 2011

(54) APPLICATION OF SOLIDS

(75) Inventors: Rishi I. Dean, Boston, MA (US); Kyungmin Andy Lee, Wyckoff, NJ (US); Holli J. McCaffery, Boston, MA (US); Timothy R. McCaffery, Boston, MA (US); Zachary Z. Zguris, Canterbury, NH (US)

(73) Assignee: Lime Design, Inc., Boston, MA (US)

( * ) Notice: Subject to any disclaimer, the term of this patent is extended or adjusted under 35 U.S.C. 154(b) by 1146 days.

(21) Appl. No.: 11/747,859

(22) Filed: May 11, 2007

(51) Int. Cl.
*B05C 5/02* (2006.01)

(52) U.S. Cl. ..... 118/13; 118/18; 118/24; 118/308; 141/352; 141/364; 141/365; 141/366

(58) Field of Classification Search ..... 118/13, 118/18, 24, 308; 141/351, 352, 360, 362–366; 99/494; 427/180, 284, 287; 206/219, 221, 206/222; 366/156.1; 215/DIG. 8
See application file for complete search history.

(56) References Cited

U.S. PATENT DOCUMENTS 3,129,853 A * 4/1964 Hoskins ..... 222/339
3,211,334 A * 10/1965 McShea ..... 222/39
3,249,266 A * 5/1966 Cole et al. ..... 222/362
D397,913 S * 9/1998 Milliani ..... D7/589
7,328,670 B2 * 2/2008 Puentes-Barr ..... 118/13

* cited by examiner

*Primary Examiner* — Laura Edwards
(74) *Attorney, Agent, or Firm* — Finch & Maloney PLLC

(57) ABSTRACT

A method of applying a solid to a container includes placing a portion of the container between two surfaces, at least one of the surfaces being movable relative to the other surface to define a variable space between the surfaces; and applying the solid to a selected portion of the container. In some embodiments, the solid includes a flavor enhancer, and the selected portion is proximate a rim edge of the container.

12 Claims, 8 Drawing Sheets

APPLICATION OF SOLIDS

TECHNICAL FIELD

The invention relates to apparatuses and methods for applying solids, for example, granulated solids.

BACKGROUND

Granulated solids have been applied to the rim portion of glassware as a flavor enhancer for beverages. For example, a margarita or a beer may be served in a salt-rimmed glass, a daiquiri may be served in a sugar-rimmed glass, a bloody Caesar may be served in a celery salt and pepper-rimmed glass, and non-alcoholic beverages, such as mulled cider, may be served in a cinnamon spice-rimmed glass. These beverages can be prepared by wetting the rim portion of a glass, for example, by dipping the rim portion into shallow dish of water, and then dipping the rim portion into a reservoir containing the selected granulated solids. The glass can then be filled with the desired contents.

SUMMARY

The invention relates to apparatuses and methods for applying solids.

In one aspect, the invention features apparatuses and methods that can be used to apply a solid (e.g., granulated solids) to a selected portion of a beverage container (e.g., a rim portion of a glass). For example, a user can wet the rim portion of a glass, apply a solid to the rim portion, and pour a beverage into the glass. The user can also pour a beverage in a glass, wet the rim portion of the glass, and lastly apply the solid to the rim portion. In other words, the apparatuses and methods allow the solid to be applied to the container regardless of whether the container is empty or not. The user can apply the solid to the container after the beverage is poured into the container (e.g., if the user has forgotten to apply the solid). In some implementations, the addition of the beverage causes the solid to fall off the rim portion, so applying the solid last can prevent the solid from falling. The user can reapply the solid to the container when at least some of the beverage is in the glass (e.g., if the previously-applied solid has been consumed or otherwise removed, or if the intended consumer prefers more solids than what was applied). The apparatuses and methods can obviate the need for another container to apply or to reapply the solids.

The apparatuses and methods can be used with containers having different forms, diameters and/or wall thicknesses. For example, the apparatuses and methods can be used with a beer glass, a champagne flute, a coffee cup, a margarita glass, a martini glass, and a wine glass. There is no need for a solid-containing reservoir into which the container is dipped to have a diameter larger than a diameter of the container.

The apparatuses and methods can apply the solid in a relatively clean manner. For example, solids that do not adhere directly to the container are well-contained (e.g., are not dispersed across local surfaces and/or fall into the container). After application of the solids, the beverage can be served with low loss of the solids, e.g., due to the solids being disturbed and detaching from the container.

The apparatuses and methods can include dispensing mechanisms that can be packaged as handheld versions or countertop automated versions.

In another aspect, the invention features a method of applying a solid to a container, including placing a portion of the container between two surfaces, at least one of the surfaces being movable relative to the other surface to define a variable space between the surfaces; and applying the solid to a selected portion of the container.

Embodiments may include one or more of the following features. The method further includes wetting the selected portion of the container. The method further includes agitating the solid prior to applying the solid. Agitating the solid can includes rotating a wheel, turning a handle, pushing a spring. The method further includes moving at least one of the surfaces to increase the space between the surfaces after applying the solid. The container contains a liquid. The solid includes a flavor enhancer, and the selected portion is proximate a rim portion of the container. The method further includes providing an apparatus having the two surfaces and holding the solid; and moving at least the apparatus or the container relative to each other to apply the solid.

In another aspect, the invention features a method of applying flavor enhancing solids to a beverage container, the method including wetting a selected portion proximate a rim portion of the container; placing a wall portion of the container between two surfaces capable of defining a space variable in size between the surfaces; and applying the flavor enhancing solids the selected portion.

Embodiments may include one or more of the following features. The method further includes agitating the solids prior to applying the solids. The container contains a liquid prior to placing the wall portion of the container between the two surfaces. The method further includes providing an apparatus having the two surfaces and holding the flavor enhancing solids; and moving at least the apparatus or the container relative to each other to apply the solids.

In another aspect, the invention features an apparatus, including a first chamber capable of holding a solid particle; a passageway in fluid communication with the first chamber; a first surface and a second surface capable of defining a space variable in size between the surfaces, the space being configured to receive a wall portion of a beverage container; and a second chamber in fluid communication with the passageway, the second chamber being between the passageway and the space along a fluid path. The chamber(s) need not be completely enclosed.

Embodiments may include one or more of the following features. The apparatus further includes a rotatable wheel having the first surface, and an agitator in the first chamber and connected to the wheel. The apparatus further includes a spring-biased member having the second surface. The apparatus further includes a flow controller capable of controlling flow through the passageway. The apparatus further includes flavor enhancing particles in the first chamber. The apparatus further includes a member having threads in the first chamber. The member is spring actuated. The member is rotatable.

In another aspect, the invention features an apparatus for applying flavor enhancing solids to a beverage container, the apparatus including a first chamber holding the solids; a passageway in fluid communication with the first chamber; a flow controller capable of controlling flow through the passageway; a first surface and a second surface capable of defining a space variable in size between the surfaces, the space being configured to receive a wall portion of a beverage container; and a second chamber in fluid communication with the passageway, the second chamber being between the passageway and the space along a fluid path. The chamber(s) need not be completely enclosed.

Embodiments may include one or more of the following features. The apparatus further includes a rotatable wheel having the first surface, and an agitator in the first chamber and connected to the wheel. The apparatus further includes a spring-biased member having the second surface. The apparatus further includes a member having threads in the first chamber. The member is spring actuated. The member is rotatable.

As used herein, "proximate a rim edge of a container" means sufficiently near a rim edge of the container that a consumer placing his mouth on a selected rim portion of the container can consume the solid applied to the selected rim portion. In some embodiments, "proximate a rim edge of a container" means within about one centimeter (e.g., less than or equal to about 5 mm) from a rim edge of the container.

Other aspects, features and advantages will be apparent from the description of the embodiments thereof and from the claims.

DETAILED DESCRIPTION

Figure 1:
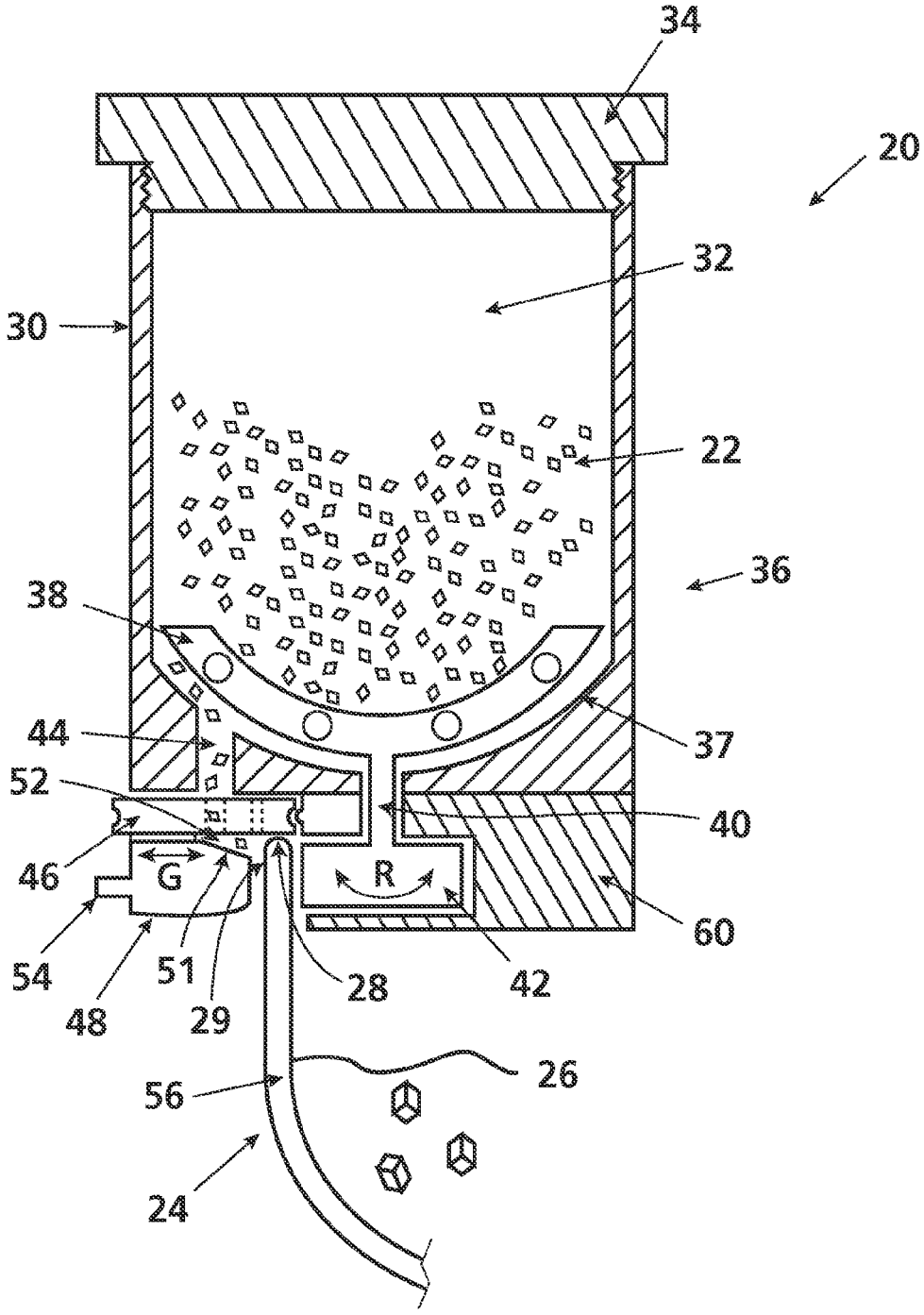
FIG. 1 is a cross-sectional diagram of an embodiment of an applicator of solids.

FIG. 1 shows an applicator 20 capable of applying solid particles 22 to one or more selected portions of a container 24 containing a liquid 26. For example, solid particles 22 can include a flavor enhancer (such as salt), container 24 can be a piece of glassware having a rim edge 28, and liquid 26 can be beverage (such as a margarita). As a result, applicator 20 is capable of applying the flavor enhancer to the glassware to provide, for example, a salt-rimmed margarita.

Figure 2A:
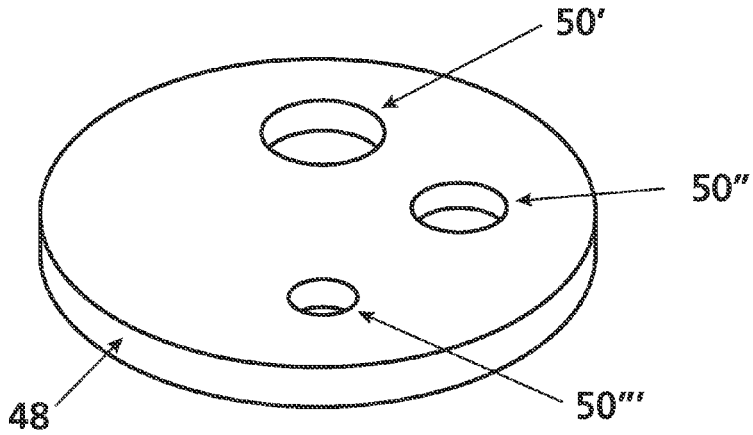
FIG. 2A is a perspective view of an embodiment of flow control plate.
Figure 2B:
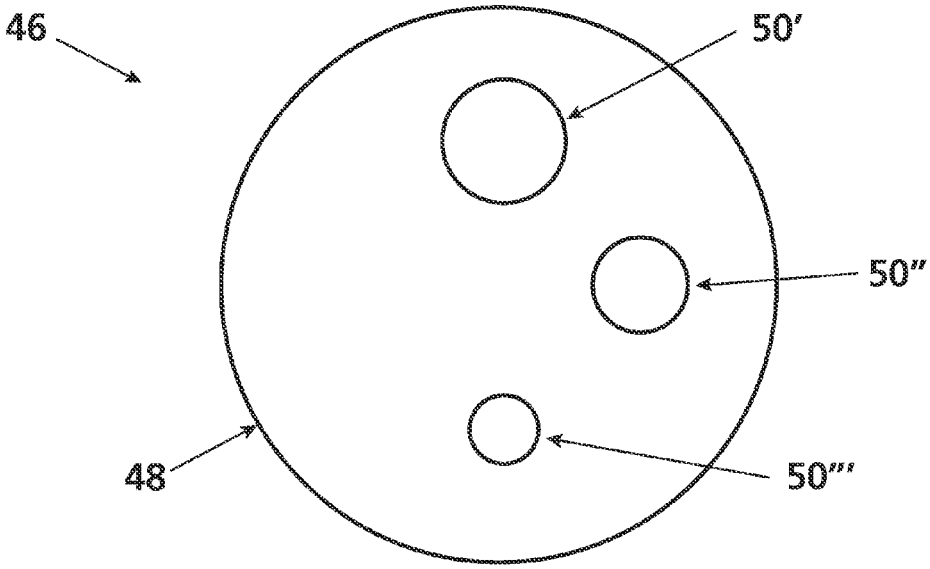
FIG. 2B is a plan view of the control plate shown in FIG. 2A.
Figure 3:
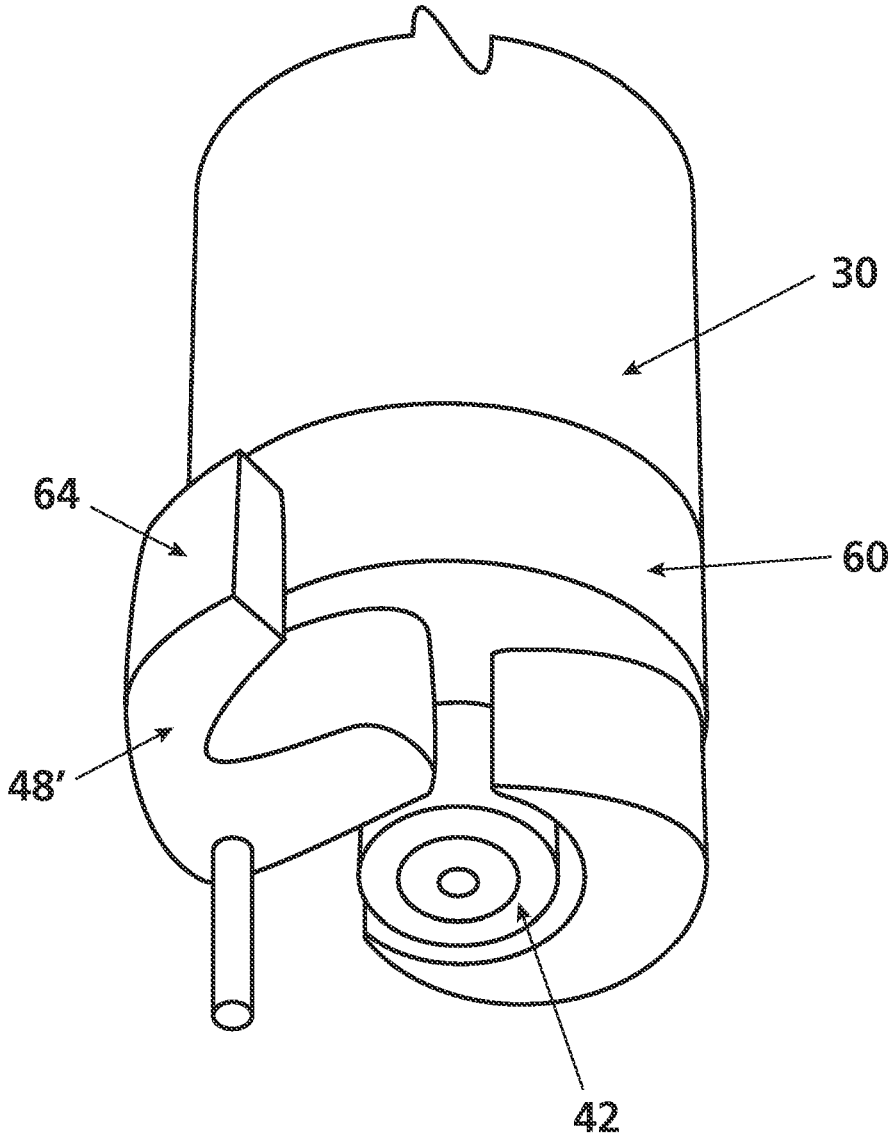
FIG. 3 is a partial, perspective view of an embodiment of an applicator of solids.

Still referring to FIG. 1, applicator 20 includes a housing 30, a filling cap 34 removably attached to the housing, and a dispensing mechanism 36 for applying the particles to container 24. Housing 30 has a chamber 32 in which particles 22 are stored, and the chamber has a sloped (e.g., conical) surface 37 to help direct the particles toward dispensing mechanism 36. As shown, dispensing mechanism 36 includes an agitator 38 (as shown, a blade) located in chamber 32, a shaft 40 connected the agitator, and a rotatable wheel 42 (arrow R) connected to the shaft. Dispensing mechanism 36 further includes a passageway 44 that is in fluid communication with chamber 32 and leads to a flow controller 46 and a tension guide 48. Referring to FIGS. 2A and 2B, flow controller 46 is a circular plate 48 having openings 50', 50", 50'" of different sizes that enable applicator 20 to accommodate solids with different particle sizes. Flow controller 46 is rotatably mounted in applicator 20 so that openings 50', 50", 50'" can be selectively aligned with passageway 44, thereby controlling the flow rate of particles 22 exiting the passageway from chamber 32. Referring back to FIG. 1, tension guide 48 is movably mounted to applicator 20 (as shown, laterally slidable (arrow G)) and is spring-biased toward wheel 42. Tension guide 48 has a top surface 51 that partially defines a volume 52 into which particles 22 enter after exiting opening 50', 50" or 50'". In other words, volume 52 is in fluid communication with chamber 32 via an opening of flow controller 46 and passageway 44. As shown, tension guide 48 has a tab 54 to move the tension guide away from wheel 42. In other embodiments, tension guide 48 includes other features (such as an indentation (FIG. 3) or a textured surface) to help move the tension guide.

During use, a wall portion 56 of container 24 is placed between wheel 42 and tension guide 48, and the container and/or applicator 20 is moved relative to the other to apply particles 22 to a rim portion 29 proximate to rim edge 28. Container 24 can contain a liquid or be empty. More specifically, selected area(s) of rim edge 28 and/or area(s) of rim portion 29 (e.g., the outer surface of wall portion 56 proximate to the rim edge) are first wetted so that particles 22 can be applied to the wetted area(s). For example, the selected area(s) can be wetted by dipping rim edge 28 and rim portion 29 into a shallow dish of water or syrup, or if container 24 contains a liquid, by passing a slice of lime, a slice of lemon, a piece of ice, a wet sponge, or a wet swab on the rim edge and/or the rim portion. Next, to increase the space or gap, if any, between tension guide 48 and wheel 42, the tension guide is moved against its spring bias and away from the wheel. This ability of tension guide 48 to move relative to wheel 42 allows applicator 20 to accommodate and to apply particles 22 to containers 24 having different wall thicknesses. Next, wall portion 56 is placed in the increased space between the tension guide and the wheel, and the tension guide is released and allowed to move under its spring bias toward the wheel to contact an exterior surface of the wall portion. As a result, wall portion 56 is held between and in contact with tension guide 48 and wheel 42.

To apply particles 22 to the wetted area(s), container 24 and/or applicator 20 is moved relative to the other. For example, container 24 can be held stationary, and applicator 20 (e.g., a handheld design) can be moved to track rim edge 28. As applicator 20 moves, an interior surface of wall portion 56 engages and rotates wheel 42, thereby causing agitator 38 to rotate and to move particles 22 in chamber 32. The movement of particles 22, along with gravity, causes the particles to flow from chamber 32, through passageway 44, through a selectively aligned opening of flow controller 46, through volume 52, and to container 24 where the particles are applied to a wetted area(s). To enhance the performance of applicator 20, wheel 42 can include (e.g., is formed of) a frictional material, such as rubber, so that wall portion 56 can easily rotate the wheel and agitator 38, and/or tension guide 48 can include (e.g., is formed of) a lubricious material, such as PTFE, so that the wall portion easily glide against the area of the tension guide that the wall portion contacts. In some embodiments, applicator 20 is held stationary, and container 24 is moved, e.g., in a circular path that tracks the shape of rim edge 28. Particles 22 are delivered from chamber 32 and applied to container 24 according to the same operation described above.

After particles 22 are applied to container 24, tension guide 48 is moved away from wheel 42 to increase the space between the tension guide and the wheel, and container 24 is disengaged from applicator 20. Stopping the rotation of wheel 42 and agitator 38 can reduce or stop the flow of particles 22 from chamber 32. Furthermore, flow controller 46 can be adjusted so that none of openings 50', 50", 50'" aligns with passageway 44. Moreover, in some embodiments, when applicator 20 is not in use and tension guide 48 is allowed to move toward wheel 42, the tension guide contacts the wheel (i.e., there is no gap between the tension guide and the wheel), thereby preventing particles 22 (if any) from exiting volume 52.

While a number of embodiments have been described, the invention is not so limited.

For example, referring to FIG. 1, in some embodiments, an applicator includes friction-reducing devices (such as a set of ball bearings or a set of roller bearings) between housing 30 and a block 60 (see also FIG. 3), which interfaces with container 24. The friction-reducing devices allow housing 30 to move separately from other components of the applicator, and the applicator to move easily on the container. In some embodiments, a shell (e.g., an ergonomically-designed shell shown in FIG. 9) can be attached to housing 30, and the friction-reducing devices can be placed between the housing and the shell.

As another example, other embodiments of a tension guide can be implemented in the embodiments of applicators described herein. For example, referring to FIG. 3, a tension guide 48' can be pivotally mounted to an applicator. As shown, tension guide 48' is pivotally mounted with a pin 62 and includes an extended portion 64 that is used to move the tension guide away from wheel 42.

Figure 4:
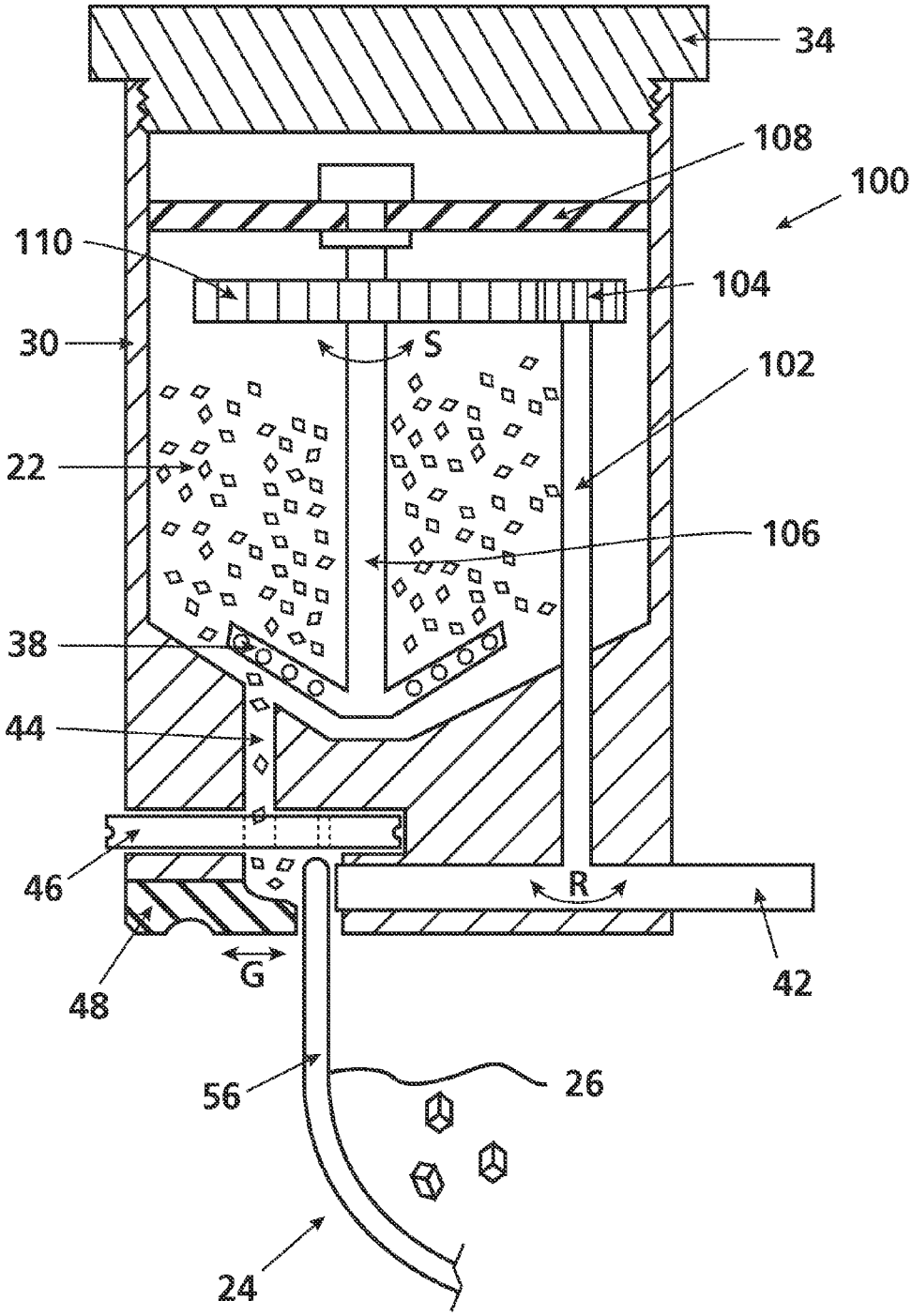
FIG. 4 is a cross-sectional diagram of an embodiment of an applicator of solids.

Still other embodiments of moving particles 22 can be implemented. For example, FIG. 4 shows an applicator 100 in which wheel 42 and agitator 38 engage each other through gears. As shown, wheel 42 is connected to shaft 102 that is connected to a first gear 104. Agitator 38 is connected to a shaft 106 that can rotate (arrow S) and is held in position by a support 108 in housing 30. Shaft 106 of agitator 30 is connected to a second gear 110 that is configured to engage with first gear 104 connected to shaft 102. During use, wheel 42 rotates, thereby causing shaft 102 and first gear 104 to rotate. Rotation of first gear 104 causes second gear 110 to rotate, thereby rotating agitator 38. Applicator 100 operates similarly to how applicator 20 operates.

Figure 5:
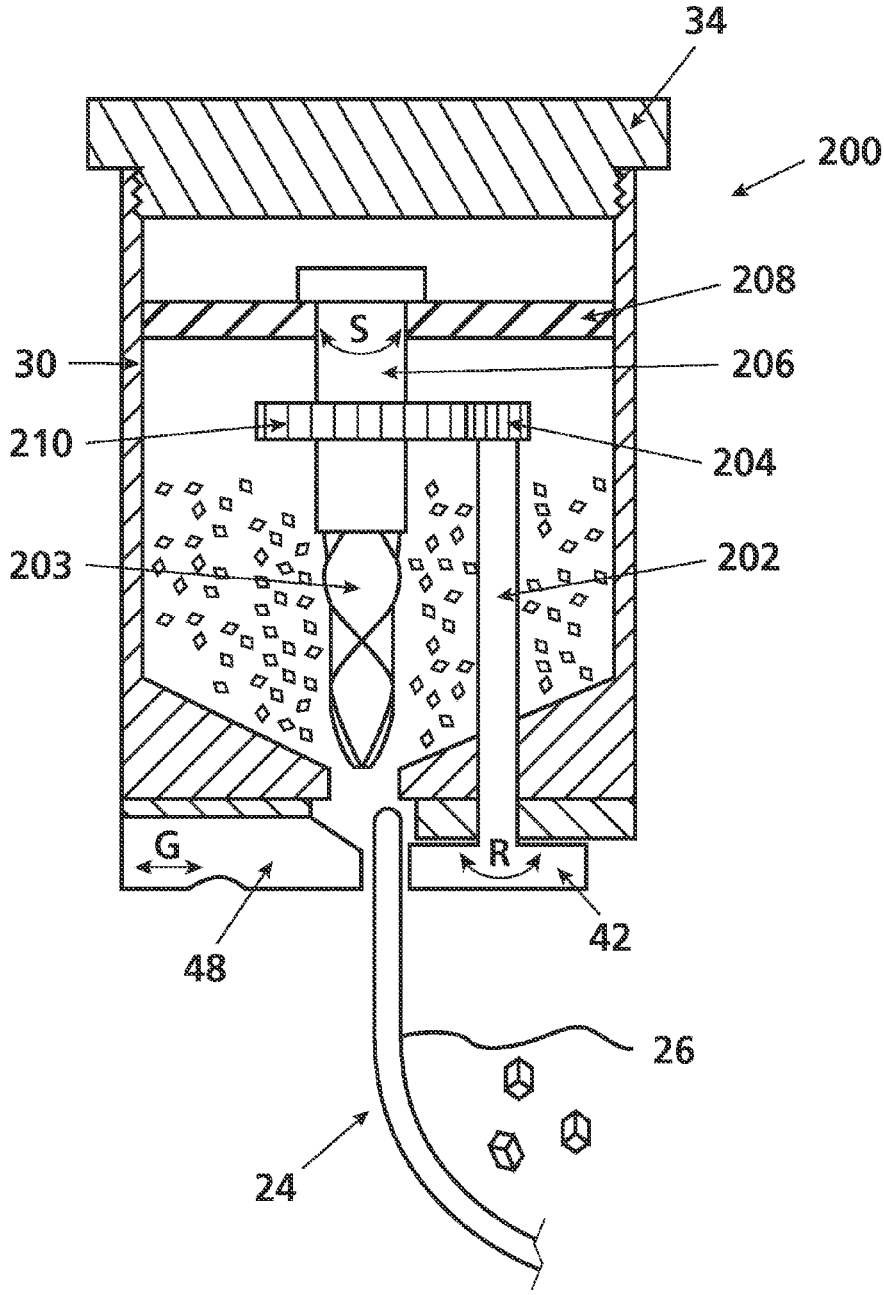
FIG. 5 is a cross-sectional diagram of an embodiment of an applicator of solids.

In other embodiments, agitator 38 of applicator 100 is replaced by a screw feed, such as an elongated rod having external threads. As shown in FIG. 5, applicator 200 includes wheel 42 that is connected to a shaft 202 that is connected to a first gear 204. Applicator 200 further includes a screw feed 203 connected to a shaft 206 that can rotate (arrow S) and is held in position by a support 208 in housing 30. Shaft 206 is connected to a second gear 210 that is configured to engage with first gear 204 connected to shaft 202. Rotation of first gear 204 causes second gear 210 to rotate, thereby rotating screw feed 202.

Figure 6:
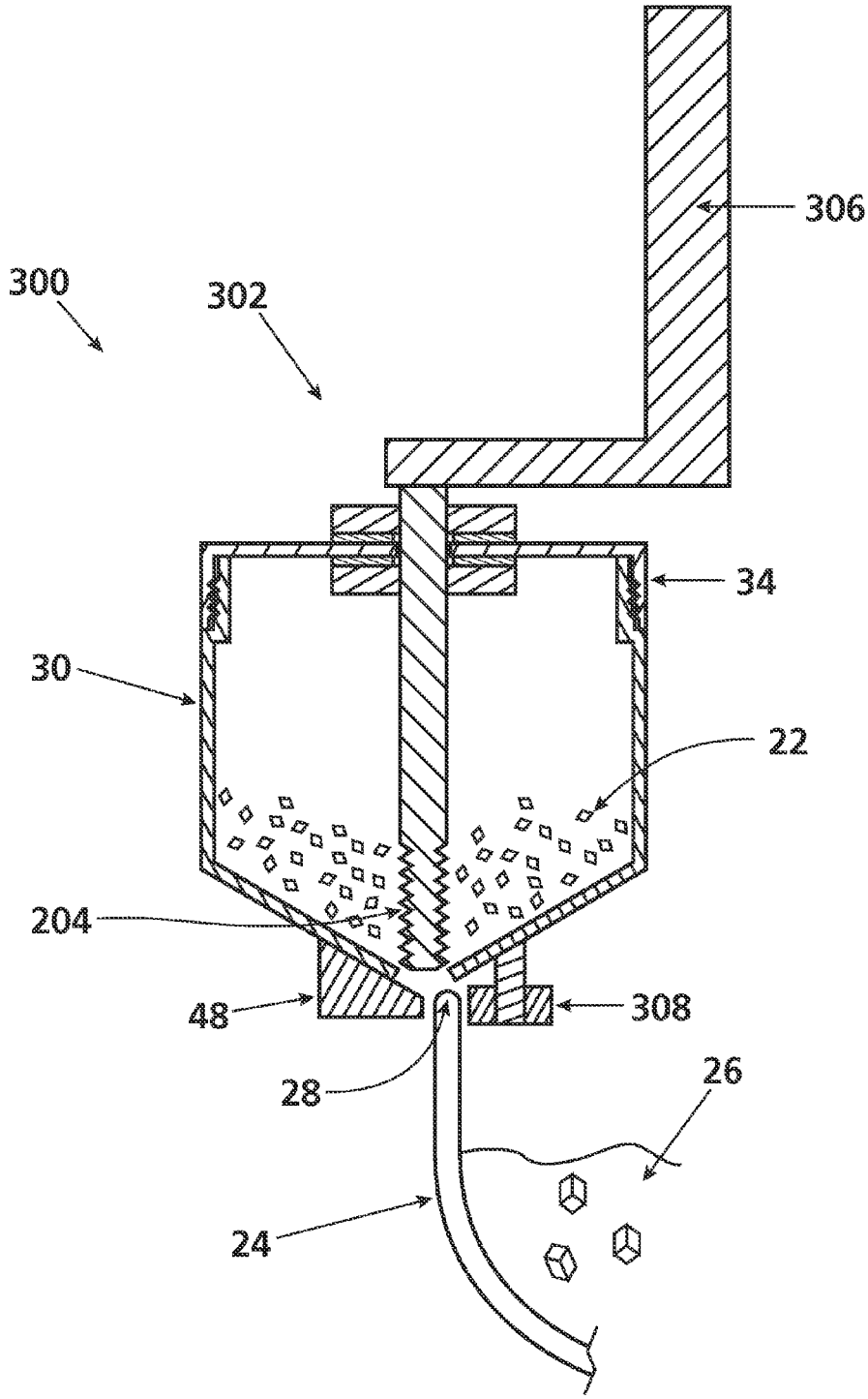
FIG. 6 is a cross-sectional diagram of an embodiment of an applicator of solids.

FIG. 6 shows an applicator 300 having a screw feed mechanism 302. As shown, mechanism 302 includes a screw feed 304 (such as a rod having external threads) supported by removable cap 34 and connected to an off-axis handle 306. As shown, applicator 300 further includes a rotatable wheel 308 connected to housing 30, and tension guide 48, but in some embodiments, the tension guide is omitted. In operation, a user places a wall portion of container 24 between wheel 308 and tension guide 48, turns handle 306, and moves applicator 30 to track rim edge 28. Rotation of handle 306 causes screw feed 304 to rotate and to agitate particles 22. This agitation, along with gravity and sloped inner wall of housing 30, causes particles 22 to travel to screw feed 204 (e.g., the threads of the rod), where the particles travel further downward and are guided and applied to selected portions of container 24.

Figure 7:
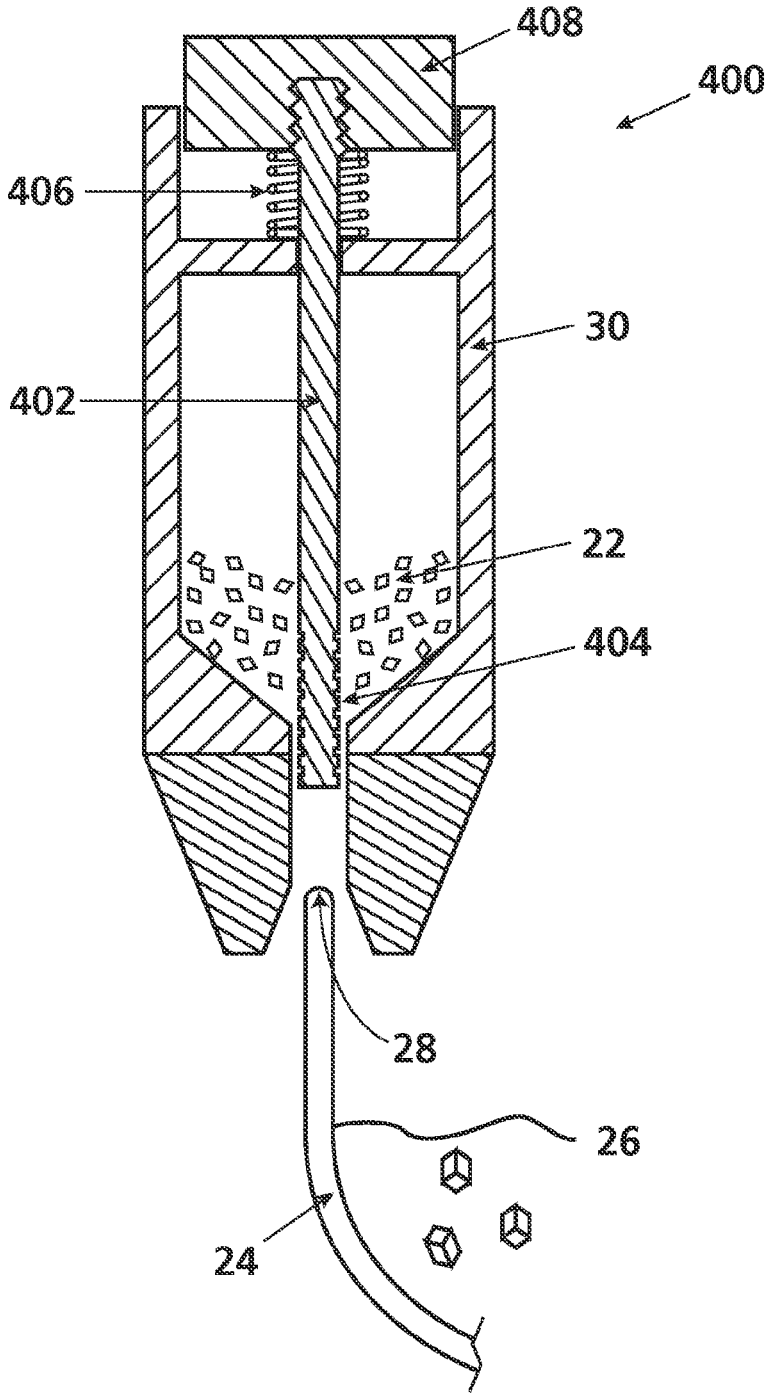
FIG. 7 is a cross-sectional diagram of an embodiment of an applicator of solids.
Figure 8:
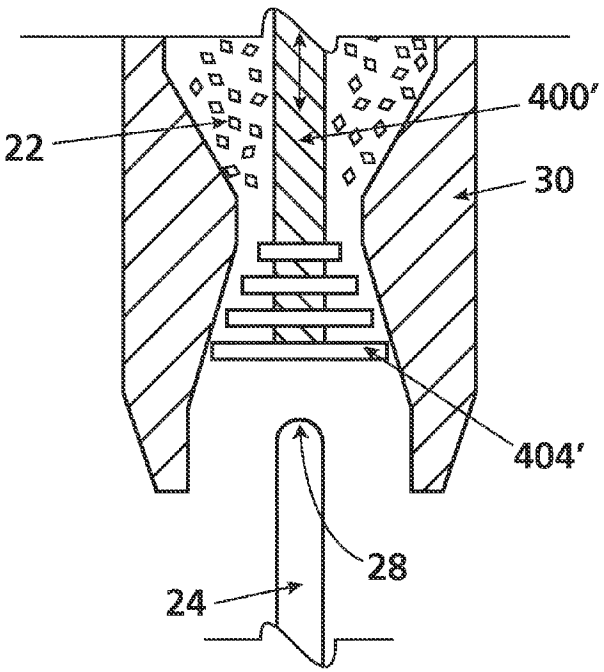
FIG. 8 is a detailed, cross-sectional diagram of an embodiment of an applicator of solids.

FIG. 7 shows an applicator 400 having a spring-loaded mechanism. As shown, applicator 400 includes an elongated rod 402 having outwardly extending fins 404 (e.g., including a compressible material such as a polymer) at a first end portion, and connected to a spring 406 and an actuator 408 (e.g., a button) and a second end portion. In operation, a user moves applicator 400 to track rim edge 28 and continuously depresses actuator 408 and spring 406 to allow particles 22 to be applied to selected portions of container 24. In some embodiments, actuator 408 and spring 406 can be intermittently depressed during operation to agitate particles 22, thereby aiding application of the particles. In some embodiments, referring to FIG. 8, the degree to which fins 404' extend outwardly from rod 402 can vary along the length of the rod (e.g., in a gradient), and the passageway of applicator 400' through which particles 22 travel can have a conversely varying width or diameter. As a result, when applicator 400' is not being used, a fin can engage with the passageway (e.g., like a valve engaging with a valve seat), thereby preventing particles 22 from exiting applicator 400'. During operation, when rod 402 is pushed toward the exit passageway, the fin previously engaged with the passageway becomes disengaged from the passageway, and particles 22 can exit applicator 400'.

Figure 9:
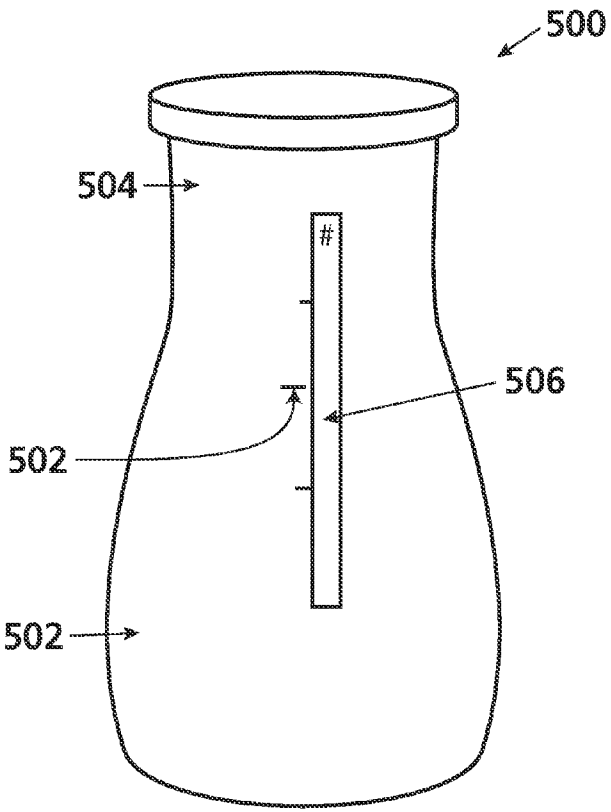
FIG. 9 is a perspective view of an embodiment of an applicator of solids.

An applicator can have a variety of external shapes and is not limited to, for example, a cylindrical design. FIG. 9 shows an applicator 500 having a first portion 502 and a relatively narrower second portion 504 that allows the applicator to be grasped more firmly and comfortably. In addition to enhancing the function of an applicator, varying the external shapes can allow a designer to customize the outward appearance of the applicator to appeal to different consumers.

In some embodiments, as shown in FIG. 9, a reservoir of an applicator includes a transparent window 506 and indicia 508 that allow the amount of solids in the reservoir to be ascertained, e.g., for re-filling.

In other embodiments, an applicator is intended to be disposable, vis-à-vis reusable. The applicator may be pre-filled with a flavor enhancer prior to being provided to a user. The applicator may not include a filling cap.

Other agitators, such as a propeller, a paddle, and a hook, can be used.

In some embodiments, a flow controller includes a tactile indicator (e.g., one or more notches on the perimeter of the controller) and/or a visual indicator (e.g., numerical markings) to indicate through which opening solid particles will flow during use.

One or more components of an applicator can include (e.g., is formed of) a material that reduces and/or prevents microbial growth. For example, the wheel and the tension guide, both of which contact a container during use, can include an antimicrobial material.

Still other embodiments are within the scope of the following claims.

What is claimed is:

1. An apparatus, comprising:

a first chamber capable of holding a solid particle;

a member comprising threads in the first chamber;

a passageway in fluid communication with the first chamber;

a first surface and a second surface capable of defining a space variable in size between the surfaces, the space being configured to receive a wall portion of a beverage container; and a volume in fluid communication with the passageway, the volume being between the passageway and the space along a fluid path.

2. The apparatus of claim 1, further comprising a rotatable wheel comprising the first surface, and an agitator in the first chamber and connected to the wheel.

3. The apparatus of claim 1, further comprising a spring-biased member comprising the second surface.

4. The apparatus of claim 1, further comprising a flow controller capable of controlling flow through the passageway.

5. The apparatus of claim 1, further comprising flavor enhancing particles in the first chamber.

6. The apparatus of claim 1, wherein the member is spring actuated.

7. The apparatus of claim 1, wherein the member is rotatable.

8. An apparatus for applying flavor enhancing solids to a beverage container, the apparatus comprising:

a first chamber holding the solids;

a member comprising threads in the first chamber;

a passageway in fluid communication with the first chamber;

a flow controller capable of controlling flow through the passageway;

a first surface and a second surface capable of defining a space variable in size between the surfaces, the space being configured to receive a wall portion of a beverage container; and a volume in fluid communication with the passageway, the volume being between the passageway and the space along a fluid path.

9. The apparatus of claim 8, further comprising a rotatable wheel comprising the first surface, and an agitator in the first chamber and connected to the wheel.

10. The apparatus of claim 8, further comprising a spring-biased member comprising the second surface.

11. The apparatus of claim 8, wherein the member is spring actuated.

12. The apparatus of claim 8, wherein the member is rotatable.

* * * * *